US009957788B2

(12) United States Patent
McChesney et al.

(10) Patent No.: US 9,957,788 B2
(45) Date of Patent: May 1, 2018

(54) STEAM INJECTION TOOL

(71) Applicant: HALLIBURTON ENERGY SERVICES, INC., Houston, TX (US)

(72) Inventors: Ryan Wesley McChesney, Carrollton, TX (US); Austin Lee Wright, Dallas, TX (US); Stephen Michael Greci, Little Elm, TX (US); Uriel Arias, Lewisville, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 288 days.

(21) Appl. No.: 14/441,259

(22) PCT Filed: May 30, 2014

(86) PCT No.: PCT/US2014/040126

§ 371 (c)(1),
(2) Date: May 7, 2015

(87) PCT Pub. No.: WO2015/183292

PCT Pub. Date: Dec. 3, 2015

(65) Prior Publication Data

US 2016/0298434 A1 Oct. 13, 2016

(51) Int. Cl.
*E21B 43/25* (2006.01)
*E21B 43/24* (2006.01)
(Continued)

(52) U.S. Cl.
CPC ..... *E21B 43/2406* (2013.01); *E21B 34/06* (2013.01); *E21B 41/0078* (2013.01); *E21B 43/24* (2013.01)

(58) Field of Classification Search
CPC .... E21B 43/2406; E21B 34/06; E21B 34/007; E21B 41/0078; E21B 43/24
See application file for complete search history.

(56) References Cited

U.S. PATENT DOCUMENTS 2,631,000 A 3/1953 Lee
3,071,193 A 1/1963 Raulins
(Continued)

FOREIGN PATENT DOCUMENTS

CA 281500 3/1928
CA 2249128 4/2000
(Continued)

OTHER PUBLICATIONS

International Patent Application No. PCT/US2014/040126 , International Search Report and Written Opinion, dated Feb. 9, 2015, 13 pages.

*Primary Examiner* — Brad Harcourt
(74) *Attorney, Agent, or Firm* — Kilpatrick Townsend & Stockton LLP

(57) ABSTRACT

Fluid injection tools for use in a wellbore can be configured on-site prior to run-in and can be opened or closed on demand when positioned in the well. A fluid injection tool can be used to provide steam to a wellbore annulus during a steam assisted gravity drainage procedure. Nozzles in the tool through which the steam escapes can be individually plugged to enable fine-tuning of steam output to match a desired steam output for that particular tool's location within the wellbore. A sliding side door can be actuated, such as by a shifting tool inserted within the inner diameter of the fluid injection tool, to enable or disable steam output from the fluid injection tool.

16 Claims, 6 Drawing Sheets

(51) Int. Cl.
*E21B 34/06* (2006.01)
*E21B 41/00* (2006.01)

(56) References Cited

U.S. PATENT DOCUMENTS

| | | | |
|---|---|---|---|
| 3,396,797 | A | 8/1968 | Little et al. |
| 3,860,068 | A | 1/1975 | Abney |
| 4,081,028 | A | 3/1978 | Rogers |
| 4,081,032 | A | 3/1978 | Hutchison et al. |
| 4,099,563 | A | 7/1978 | Hutchison et al. |
| 4,399,865 | A | 8/1983 | Anderson et al. |
| 4,429,747 | A | 2/1984 | Williamson |
| 4,949,788 | A | 8/1990 | Szarka et al. |
| 5,090,481 | A | 2/1992 | Pleasants et al. |
| 6,158,510 | A | 12/2000 | Bacon et al. |
| 6,253,853 | B1 | 7/2001 | George |
| 6,708,763 | B2 | 3/2004 | Howard et al. |
| 7,350,577 | B2 | 4/2008 | Howard et al. |
| 7,631,694 | B2 | 12/2009 | Struyk et al. |
| 7,793,716 | B2 | 9/2010 | Macias et al. |
| 7,810,567 | B2 | 10/2010 | Daniels et al. |
| 2005/0072567 | A1 | 4/2005 | Steele et al. |
| 2005/0269076 | A1 | 12/2005 | Russell |
| 2006/0162922 | A1 | 7/2006 | Chung et al. |
| 2008/0251255 | A1 | 10/2008 | Forbes et al. |
| 2009/0014168 | A1 | 1/2009 | Tips et al. |
| 2009/0139728 | A1 | 6/2009 | Schrader et al. |
| 2009/0218089 | A1 | 9/2009 | Steele et al. |
| 2010/0108313 | A1 | 5/2010 | Chan et al. |
| 2011/0214858 | A1 | 9/2011 | Castrogiovanni et al. |
| 2011/0240284 | A1* | 10/2011 | Hamid ..... E21B 43/24 166/185 |
| 2012/0199353 | A1 | 8/2012 | Fermaniuk et al. |
| 2012/0298356 | A1* | 11/2012 | Sladic ..... E21B 43/24 166/263 |
| 2014/0041852 | A1 | 2/2014 | Sims et al. |

FOREIGN PATENT DOCUMENTS

| | | |
|---|---|---|
| CA | 2765812 | 7/2013 |
| WO | 2010007403 | 1/2010 |
| WO | 2012106804 | 8/2012 |

* cited by examiner

STEAM INJECTION TOOL

CROSS-REFERENCE TO RELATED APPLICATIONS

This is a U.S. national phase under 35 U.S.C. § 371 of International Patent Application No. PCT/US2014/040126, titled "Steam Injection Tool" and filed May 30, 2014, the entirety of which is hereby incorporated by reference herein.

TECHNICAL FIELD

The present disclosure relates to oilfield operations generally and more specifically to steam assisted gravity drainage.

BACKGROUND

In oilfield operations, it can often be useful to control the passage of fluid between the inside of a wellbore tubular and an annulus between the tubular and the wellbore or casing. During steam assisted gravity drainage (SAGD) procedures, high-pressure, high-temperature steam can be injected into an upper wellbore to heat the surrounding formation, reducing the viscosity of heavy oil and bitumen in the formation, allowing the oil and bitumen to drain into a lower wellbore for production.

When a SAGD wellbore is prepared, multiple steam release nodes can be positioned along the length of the generally horizontal upper wellbore. In order to maximize the efficiency of the SAGD process, it can be desirable to adjust the amount of steam that is to be released at each node. Current SAGD nodes must be custom made to order after receipt of specifications for the particular SAGD wellbore. Custom made SAGD nodes can take a long time to prepare and ship and have extremely limited potential for re-use. Custom made SAGD nodes cannot be adjusted after manufacture or onsite in the event of changes in the SAGD wellbore specifications requiring more or less steam release from a particular node.

BRIEF DESCRIPTION OF THE DRAWINGS

The specification makes reference to the following appended figures, in which use of like reference numerals in different figures is intended to illustrate like or analogous components

DETAILED DESCRIPTION

Figure 1:
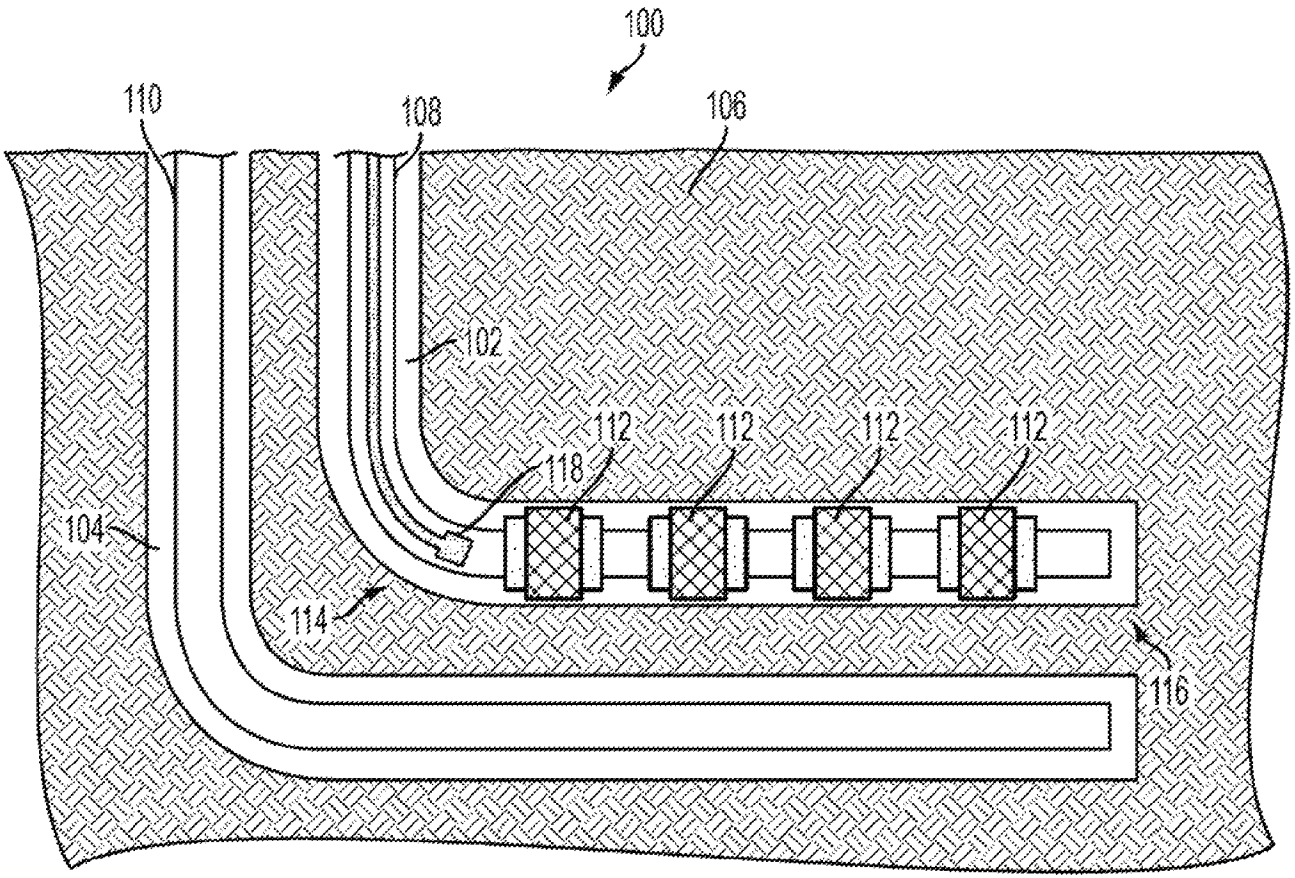
FIG. 1 is a schematic diagram of a wellbore servicing system that includes a series of fluid injection tools according to one embodiment.

Certain aspects and features of the present disclosure relate to a fluid injection tool, for use in a wellbore, that can be throttled on-site prior to run-in and can be opened or closed when positioned in the well. The fluid injection tool can be used to provide steam to a wellbore annulus. Nozzles in the tool through which the steam escapes are individually pluggable to enable fine-tuning of steam output to match a desired steam output for that particular tool's location within the wellbore. A sliding side door can be actuated, such as by a shifting tool inserted within the inner diameter of the fluid injection tool, to enable or disable steam output from the fluid injection tool.

The fluid injection tool can evenly distribute steam into a wellbore along a horizontal completion. Steam can be pumped into the fluid injection tool from the surface and can exit the nozzles of the fluid injection tool and travel axially in both directions of the completion along the annulus formed between the pipe (e.g., the fluid injection tool) and the casing or wellbore. Steam can locally heat bitumen hydrocarbon and other features of the surrounding formation to increase the temperature and lower viscosity of any hydrocarbons in the formation, allowing the hydrocarbons to flow into a lower completion and be produced to the surface.

The fluid injection tool can include a top sub, a bottom sub, an injection housing, and a sliding side door. The injection housing can include nozzles that allow fluid communication between the inner diameter of the fluid injection tool and the wellbore annulus. One or more plugs, such as National Pipe Taper Threads (NPT) plugs, can be used to block desired nozzles. The sliding side door can be actuated to isolate the fluid injection tool, completely or substantially blocking steam from escaping.

Fluid can enter the internal diameter ("ID") of the fluid injection tool through the top sub. With the sliding side door in an open position, the fluid can pass through ports in the sliding side door and into the injection housing. The fluid can then pass through the nozzles in the injection housing and into diffusers positioned adjacent the nozzles. The diffusers can lower the velocity of the fluid, such as to reduce the occurrence of damage to the casing from high-velocity particles exiting the nozzles. The diffusers can reduce the fluid's velocity without requiring a separate part that must be bolted or otherwise attached to the fluid injection tool. The diffusers can be openings formed from or within the injection housing. A diffuser can be a large, open, oval-like shape that encompasses one or more nozzles (e.g., two nozzles).

The number of nozzles allowing fluid communication with the wellbore annulus can be adjusted by inserting or removing plugs as desired. Selection of the number of plugs used allows an end user to customize the steam output for various specific regions of the completion. Plugs can also be placed into desired nozzles in order to focus steam down one axial direction (e.g., downwell) more than the other axial direction (e.g., upwell) by plugging nozzles on the undesired side of the injection housing.

With the sliding side door in a closed position, the sliding side door blocks fluid communication between the ID of the fluid injection tool and the injection housing, thus blocking fluid communication with the wellbore annulus. Any steam passing into a fluid injection tool with a closed sliding side door will continue through the bottom sub, potentially to another fluid injection tool located further downwell. Seals (e.g., gaskets, seal stacks, or other suitable seals) in the injection housing interact with the sliding side door to block all or substantially all (e.g., most) steam from exiting the closed fluid injection tool.

Standard fluid injection tools can be manufactured in large quantities and delivered to end users as identical units. Depending on the desired fluid flow characteristics, an end user can use standard or supplied plugs to customize each of the standard fluid injection tools as desired at the rig site. Increased standardization of the fluid injection tool can reduce engineering and production costs and can decrease lead times before a SAGD operation can begin producing valuable hydrocarbons.

In an alternate embodiment, a fluid injection tool can include a base pipe with orifices, a shroud covering the orifices, and one or more housings coupled to the base pipe and the shroud. The shroud and housings form an annular space between the outer diameter of the base pipe and the annulus of the wellbore. A fluid pathway is defined from the ID of the base pipe, through the orifices, and out nozzles in the housings. Pressurized fluids, such as steam, that pass through the ID of the base pipe can be dispersed into the annulus of the wellbore by passing through the fluid pathway. In an embodiment, the fluid injection tool includes a top housing and a bottom housing, each having a plurality of nozzles that can be plugged, as described above. Additionally, the housings can include diffusers, as described above.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may be drawn not to scale.

FIG. 1 is a schematic diagram of a wellbore servicing system 100 that includes a series of fluid injection tools 112 according to one embodiment. The wellbore servicing system 100 also includes a first wellbore 102 and a second wellbore 104 penetrating a subterranean formation 106 for the purpose of recovering hydrocarbons, storing hydrocarbons, disposing of carbon dioxide, or the like. The wellbores 102, 104 can be drilled into the subterranean formation 106 using any suitable drilling technique. The wellbores 102, 104 can be vertical, deviated, horizontal, or curved over at least some portions of the wellbores 102, 104. The wellbores 102, 104 can be cased, open hole, contain tubing, and can include a hole in the ground having a variety of shapes or geometries.

A first workstring 108 can be supported in the first wellbore 102 and a second workstring 110 can be supported in the second wellbore 104. One or more service rigs, such as a drilling rig, completion rig, workover rig, or other mast structures or combinations thereof can support the workstrings 108, 110 in the wellbores 102, 104 respectively, but in other examples, different structures can support the workstrings 108, 110. For example, an injector head of a coiled tubing rigup can support one of the workstrings 108, 110. In some aspects, a service rig can include a derrick with a rig floor through which one of the workstrings 108, 110 extends downward from the service rig into one of the wellbores 102, 104. The servicing rig can be supported by piers extending downwards to a seabed in some implementations. Alternatively, the service rig can be supported by columns sitting on hulls or pontoons (or both) that are ballasted below the water surface, which may be referred to as a semi-submersible platform or rig. In an off-shore location, a casing may extend from the service rig to exclude sea water and contain drilling fluid returns. Other mechanical mechanisms that are not shown may control the run-in and withdrawal of the workstrings 108, 110 in the wellbores 102, 104. Examples of these other mechanical mechanisms include a draw works coupled to a hoisting apparatus, a slickline unit or a wireline unit including a winching apparatus, another servicing vehicle, and a coiled tubing unit.

The first workstring 108 in the first wellbore 102 can include one or more fluid injection tools 112. The first wellbore 102 can have a heel 114 and a toe 116. In some embodiments, a plurality of fluid injection tools 112 can be positioned at various locations along the first wellbore 102, between the heel 114 and the toe 116. During SAGD procedures, pressurized steam can be carried down the first workstring 108 and can be released into the first wellbore 102 by the fluid injection tools 112.

As the steam heats the subterranean formation 106, hydrocarbon deposits can increase in temperature and decrease in viscosity, allowing the hydrocarbon deposits to flow into the second wellbore 104, where they are collected by the second workstring 110 for production.

In some circumstances, steam can build up in large quantities around the heel 114 and toe 116 of the first wellbore 102. The uneven distribution of steam in the first wellbore 102 results in inefficient heating of hydrocarbon deposits, reducing the efficiency of hydrocarbon production.

More desirable steam dispersion can be achieved by throttling how much steam exits the first workstring 108 at different locations along the first wellbore 102. Control of steam release can be accomplished by adjusting the fluid passageways (e.g., ports, nozzles, and other openings) in the fluid injection tools 112.

In some circumstances, it can be determined that it is no longer necessary to inject steam into certain locations within the first wellbore 102, for example because the portion of the subterranean formation 106 adjacent that location is saturated with water. In some embodiments, a fluid injection tool 112 can be closed by insertion of a shifting tool 118 into the first workstring 108. The shifting tool 118 can be any tool capable of shifting the fluid injection tool 112 from an open position to a closed position, as described in further detail herein. In some embodiments, the same or a different shifting tool 118 can be used to adjust a fluid injection tool 112 from a closed position to an open position.

Figure 2:
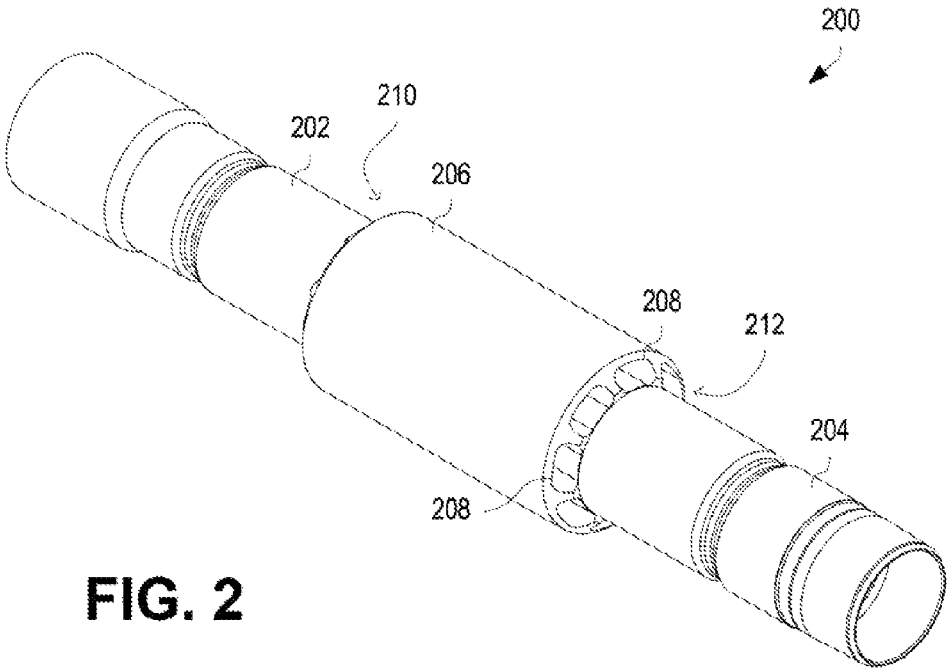
FIG. 2 is an axonometric projection of a fluid injection tool according to one embodiment.

FIG. 2 is an axonometric projection of a fluid injection tool 200 according to one embodiment. The fluid injection tool 200 can comprise a top sub 202, a bottom sub 204, and an injection housing 206. The injection housing includes diffusers 208 located at a top end 210 of the injection housing 206 and a bottom end 212 of the injection housing 206. In some embodiments, eight diffusers 208 are present at each of the top end 210 and bottom end 212. In alternate embodiments, different numbers of diffusers 208 are used, including one diffuser and more than one diffuser. The top sub 202 is positioned further upwell (e.g., towards the surface) than the bottom sub 204. In some embodiments, one of the top end 210 and bottom end 212 can be devoid of any fluid passageways and can have no diffusers 208, rendering such a fluid injection tool 200 capable of delivering fluid axially in only one direction (e.g., upwell or downwell).

In some embodiments, two or more of the top sub 202, bottom sub 204, and injection housing 206 are a single part.

Figure 3:
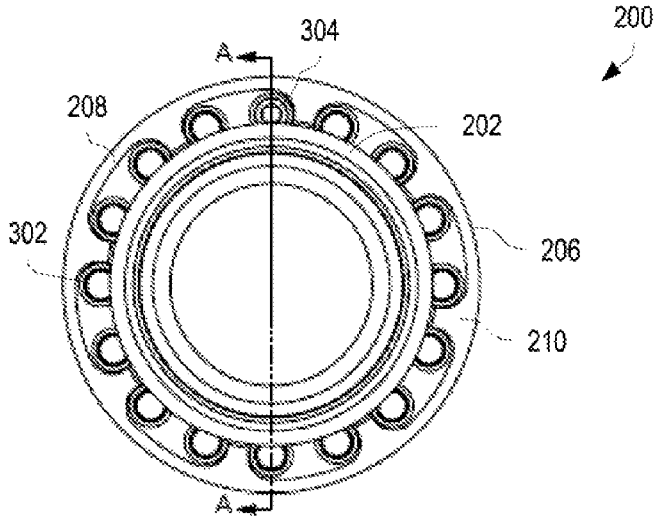
FIG. 3 is a top view of the fluid injection tool of FIG. 2 as seen looking towards the top sub and the top end of the injection housing according to one embodiment.

FIG. 3 is a top view of the fluid injection tool 200 of FIG. 2 as seen looking towards the top sub 202 and the top end 210 of the injection housing 206 according to one embodiment. The injection housing 206 includes nozzles 302. As used herein, the term nozzle refers to any opening through which fluid may be directed from the injection housing to the annulus between the fluid injection tool 200 and the first wellbore 102. The injection housing 206 can have sixteen nozzles 302, or any other number of nozzles. The injection housing 206 can include one diffuser 208 for every pair of two nozzles 302. In other embodiments, one diffuser 208 is fluidly coupled to every one nozzle 302. In yet additional embodiments, one diffuser 208 is fluidly coupled to more than two nozzles 302. Nozzles 302 at the top end 210 of the injection housing 206 can be collinear or not collinear with the nozzles 302 at the bottom end 212 of the injection housing 206. A plug 304 is seen occluding one of the nozzles 302.

Figure 4:
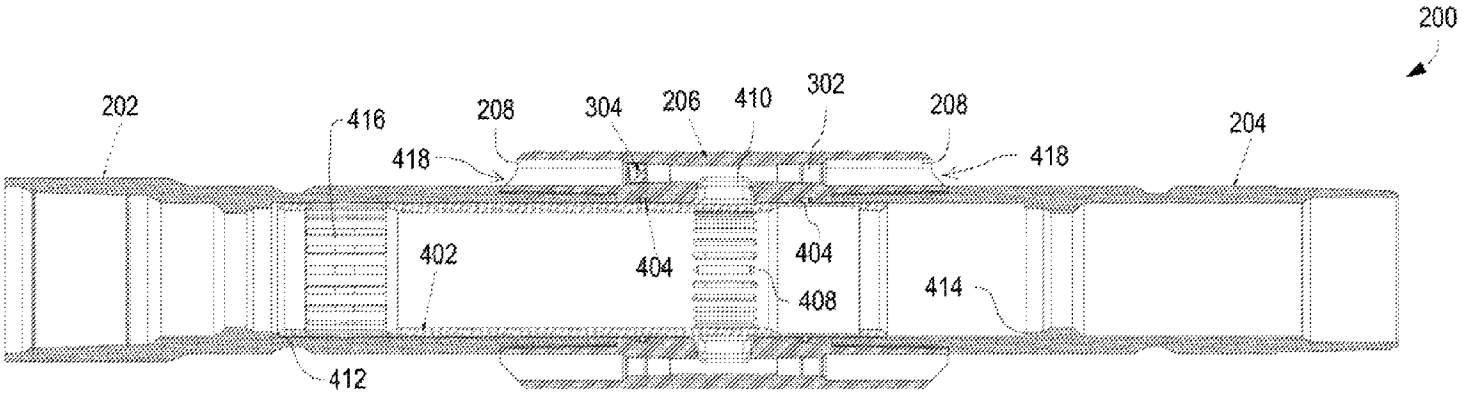
FIG. 4 is a cross-sectional view depicting the fluid injection tool of FIGS. 2-3 taken across line A-A when in an open configuration according to one embodiment.

FIG. 4 is a cross-sectional view depicting the fluid injection tool 200 of FIGS. 2-3 taken across line A-A when in an open configuration according to one embodiment. The injection housing 206 is located between the top sub 202 and the bottom sub 204. The top sub 202 and bottom sub 204 can be coupled to the injection housing 206 by any suitable coupling mechanism, such as by using tapered threads, non-tapered threads, by welding, or other suitable mechanism. A sliding door 402 is positioned within the inner diameter of the fluid injection tool 200. The sliding door 402 can be axially movable within the inner diameter of the fluid injection tool 200 between a top shoulder 412 and a bottom shoulder 414. The sliding door 402 can be held in place when in an open or closed configuration by a collet mechanism 416 or any other suitable mechanism. Seals 404 can be positioned to reduce any fluid flow around the outer diameter of the sliding door 402. In some embodiments, seals 404 can be located between the sliding door 402 and the injection housing 206.

The sliding door 402 includes orifices 408 (e.g., slots). The orifices 408 are large enough and plentiful enough to allow fluid (e.g., steam) to pass through without a significant pressure drop. In an open configuration, the orifices 408 of the sliding door 402 are positioned to allow fluid communication between the inner diameter of the fluid injection tool 200 and the accumulation chamber 410 of the injection housing 206. The accumulation chamber 410 directs fluid that enters the accumulation chamber 410 from the inner diameter of the fluid injection tool 200 to the nozzles 302. The accumulation chamber 410 can be sized sufficiently such that no appreciable pressure drop occurs until the fluid exits the nozzles 302. The accumulation chamber 410 can be sized to optimally direct steam to the nozzles 302 without an appreciable pressure drop.

A fluid pathway is defined from the inner diameter of the fluid injection tool 200, through the orifices 408 of the sliding door 402, through the accumulation chamber 410 of the injection housing 206, through the nozzles 302, and through the diffusers 208. In some embodiments, the accumulation chamber 410 is shaped to not allow fluid flow through one or more pairs of corresponding (e.g., collinear) nozzles 302. These nozzles 302 can be fluidly isolated from the ID of the fluid injection tool 200 and can therefore be used as a passageway between the top end 210 and bottom end 212 of the injection housing 206. In some embodiments, wires, cables, or other objects can be passed through the passageway created by these nozzles 302. In some embodiments, the passageway created by such nozzles 302 can be altered or manufactured differently in order to provide a protected space for wires, cables, or other objects to be passed through.

When reduced fluid output is desired for a particular fluid injection tool 200, plugs 304 can be inserted into the nozzles 302. In some embodiments, plugs 304 are NTP plugs with tapered threads that can be screwed into corresponding threads of the nozzles 302. In other embodiments, other suitable retention mechanisms are used, such as set screws, welding, pressure fittings, friction fittings, or any other suitable mechanism that seals or substantially seals the nozzle 302. In some embodiments, plugs 304 are designed to substantially block, but not completely seal the nozzle 302. In some embodiments, plugs 304 include openings, such as central holes, that allow some fluid travel, but substantially restrict fluid travel through the nozzle. In some embodiments, plugs 304 do not use elastomeric materials to create a seal.

In some embodiments a plug 304 can be a rod-shaped plug that is designed to be inserted into corresponding (e.g., collinear) nozzles 302 in the top end 210 and bottom end 212 of the injection housing 206. Such a rod-shaped plug 304 can be secured by any suitable retention mechanism, including those specifically outlined above, as well as by attaching larger elements (e.g., washers and nuts) to the ends of the rod-shaped plug 304 that extend beyond the injection housing 206, thus stopping the rod-shaped plug 304 from falling out of the injection housing 206.

In some embodiments, entire diffusers 208 can be plugged (e.g., sealed, substantially sealed, or have fluid travel restricted) through the use of plugs 304. Plugs 304 can engage threads of a diffuser 208 or of a nozzle 302 within the diffuser 208, or be held by any other suitable retention mechanism, such as those described above. In the embodiments where an entire diffuser 208 is plugged, the plug 304 can be shaped to restrict fluid travel through the entire diffuser 208, and thus through any nozzles 302 in fluid communication with only that diffuser 208, regardless of whether any of those nozzles 302 are plugged themselves.

In some embodiments the injection housing 206 can have various nozzles 302 of different diameter (e.g., internal diameter), allowing more precise fine-tuning of pressure drops to be achieved by plugging nozzles 302 of the desired diameters. In some embodiments where the injection housing 206 has nozzles 302 of varying diameters, the nozzles may have the same threading or retention mechanisms, allowing for a single, standard set of plugs 304 to be used with any desired nozzle 302.

In some embodiments, the nozzles 302 are sized to accept one-quarter-inch or one-eighth-inch plugs 304.

The diffusers 208 can be part of the injection housing 206. The diffusers 208 increase the cross-sectional area that fluid flows through when exiting the nozzles 302, before the fluid reaches the annulus of the first wellbore 102. In alternate embodiments, diffusers 208 can be separate parts that are coupled to the injection housing 206. The diffusers 208 can have leading edges 418 that are sloped. The slope of the leading edges 418 can deter hang-ups and undesirable sticking during run-in, run-out, or general movement of the fluid injection tool 200 in the first wellbore 102. This leading edge 418 can be built directly into the injection housing 206 without the need for supplemental parts or attachment mechanisms.

Figure 5:
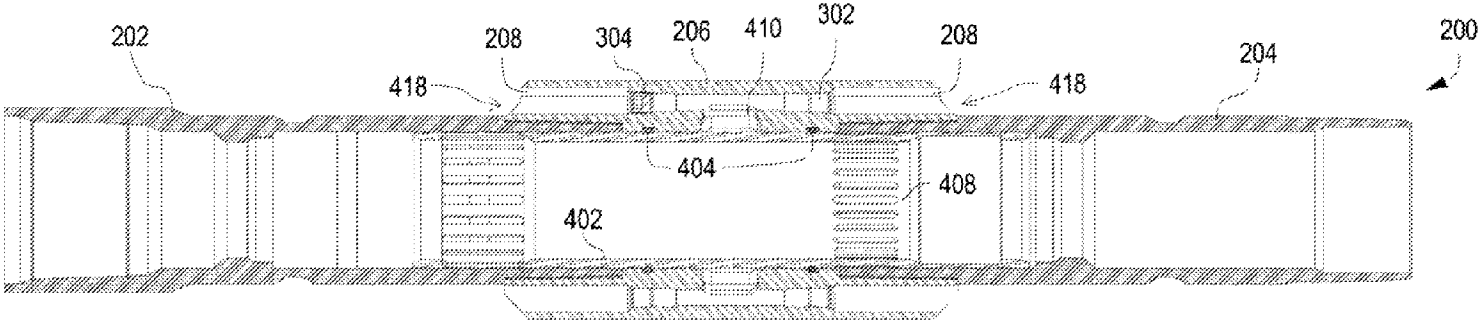
FIG. 5 is a cross-sectional view depicting the fluid injection tool of FIGS. 2-3 taken across line A-A when in a closed configuration according to one embodiment.

FIG. 5 is a cross-sectional view depicting the fluid injection tool 200 of FIGS. 2-3 taken across line A-A when in a closed configuration according to one embodiment. In a closed configuration, the sliding door 402 of the fluid injection tool 200 is axially displaced with respect to the sliding door's 402 position when in the open configuration. In the closed configuration, the orifices 408 of the sliding door 402 are positioned to not allow fluid flow between the ID of the fluid injection tool 200 and the accumulation chamber 410. In some embodiments, at least one seal 404 is located between the orifices 408 of the sliding door 402 and the accumulation chamber 410. A shifting tool can be used to adjust the position of the sliding door 402 between the open configuration and the closed configuration.

Figure 6:
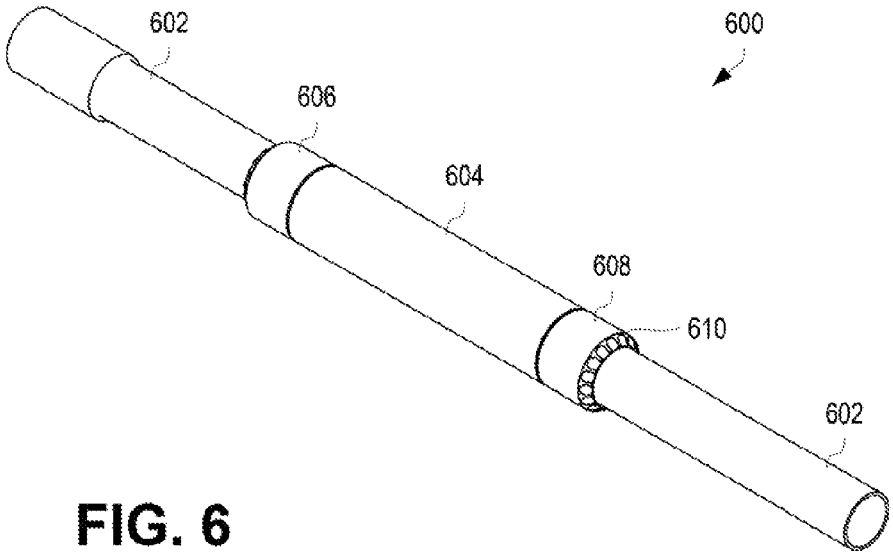
FIG. 6 is an axonometric projection of a fluid injection tool according to one embodiment.

FIG. 6 is an axonometric projection of a fluid injection tool 600 according to one embodiment. The fluid injection tool 600 includes a base pipe 602, a shroud 604, a top housing 606, and a bottom housing 608. The top housing 606 and bottom housing 608 each include diffusers 610. The top housing 606 and bottom housing 608 can each be coupled to the base pipe 602 using any suitable attachment mechanism, such as welding, bolting, crimping, or any other suitable mechanism. The top housing 606 and bottom housing 608 can each be coupled to the shroud 604 using any suitable attachment mechanism, such as welding, a threaded fit, crimping, or any other suitable mechanism. In some embodiments, sixteen diffusers 610 are present at each of the top housing 606 and bottom housing 608. In alternate embodiments, different numbers of diffusers 610 are used, including one diffuser and more than one diffuser. In some embodiments, one of the top housing 606 and bottom housing 608 can be devoid of any fluid passageways and can have no diffusers 610, rendering such a fluid injection tool 600 capable of delivering fluid axially in only one direction (e.g., upwell or downwell).

In some embodiments, two or more of the top housing 606, bottom housing 610 and shroud 604 are a single part.

Figure 7:
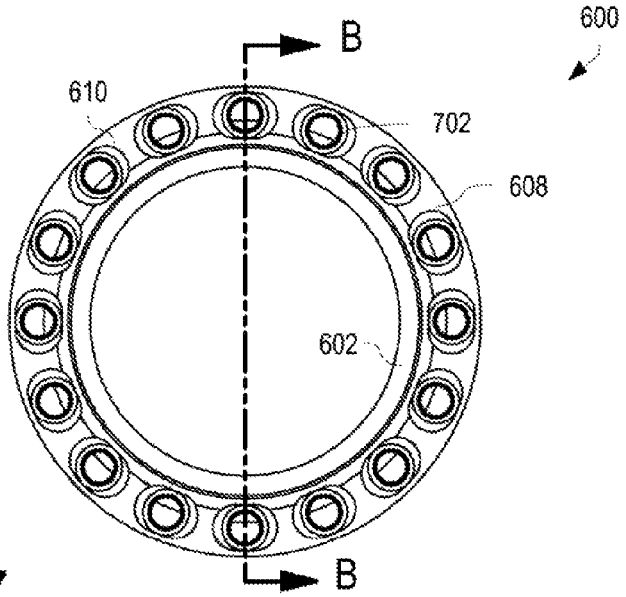
FIG. 7 is a bottom view of the fluid injection tool of FIG. 6 as seen looking towards the bottom housing according to one embodiment.

FIG. 7 is a bottom view of the fluid injection tool 600 of FIG. 6 as seen looking towards the bottom housing 608 according to one embodiment. The top housing 606 can be made as described herein with reference to the bottom housing 608. Additionally, the top housing 606 can be identical to or different from the bottom housing 608 used in a particular fluid injection tool 600.

The bottom housing 608 can include nozzles 702. The bottom housing 608 can have sixteen nozzles 702 or any other number of nozzles 702. The bottom housing 608 can include one diffuser 610 for each nozzle 702. In other embodiments, one diffuser 610 can be fluidly coupled to more than one nozzle 702. Nozzles 702 at the top housing 606 can be collinear or not collinear with the nozzles 702 at the bottom housing 608.

Figure 8:
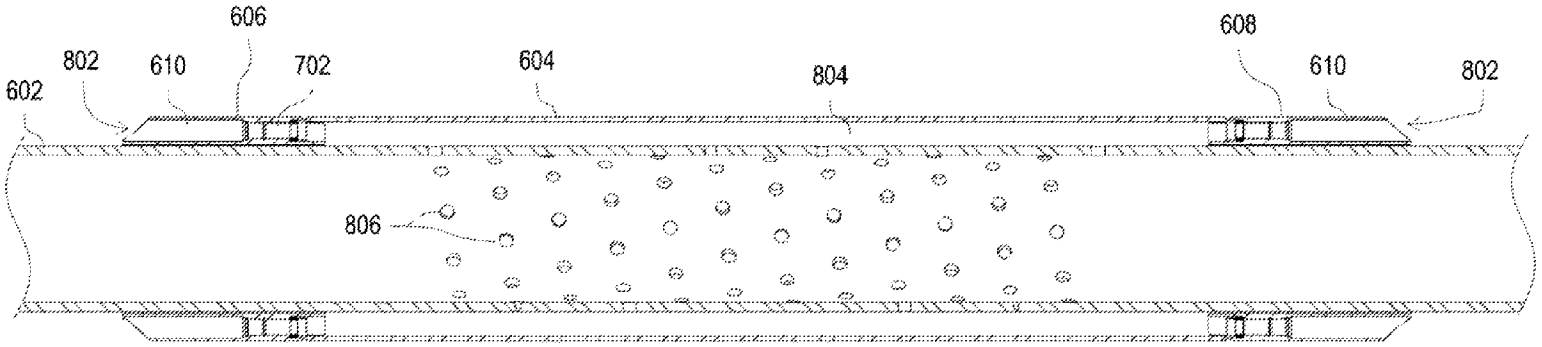
FIG. 8 is a cross-sectional view depicting the fluid injection tool of FIGS. 6-7 taken across line B-B according to one embodiment.

FIG. 8 is a cross-sectional view depicting the fluid injection tool 600 of FIGS. 6-7 taken across line B-B according to one embodiment. The fluid injection tool 600 can include a base pipe 602, a shroud 604, a top housing 606, and a bottom housing 608. The base pipe 602 can include orifices 806 for allowing fluid flowing through the internal diameter of the base pipe 602 to pass into the accumulation chamber 804 formed between the shroud 604, the base pipe 602, the top housing 606, and bottom housing 608. The base pipe 602 can be a standard pipe, such as an American Petroleum Institute (API) base pipe. The shroud 604, top housing 606, and bottom housing 608 can be appropriately attached to any prepared base pipe 602 (e.g., a base pipe 602 with orifices 806) in order to convert the base pipe 602 into a fluid injection tool 600.

The orifices 806 of the base pipe 602 are large enough and plentiful enough to allow fluid (e.g., steam) to pass through without a significant pressure drop. The length of the shroud 604 can be approximately larger than the length of the section of the base pipe 602 containing the orifices 806, so that each orifice 806 opens into the accumulation chamber 804. The accumulation chamber 804 is sized sufficiently such that no appreciable pressure drop occurs until the fluid exits the nozzles 302.

A fluid pathway is defined from the inner diameter of the fluid injection tool 600, through the orifices 806, through the accumulation chamber 804, through the nozzles 702, and through the diffusers 610. In some embodiments, the accumulation chamber 804 is shaped to not allow fluid flow through one or more pairs of corresponding (e.g., collinear) nozzles 702. These nozzles 702 can be fluidly isolated from the ID of the fluid injection tool 600 and can therefore be used as a passageway between the top housing 606 and bottom housing 608. In some embodiments, wires, cables, or other objects can be passed through the passageway created by these nozzles 702.

When reduced fluid output is desired for a particular fluid injection tool 600, plugs can be inserted into the nozzles, as described above with reference to FIGS. 3-5. Further, the nozzles 702 can have various diameters and sizes, as described above.

The diffusers 610 can be part of the top and bottom housings 606, 608. The diffusers 610 increase the cross-sectional area that fluid flows through when exiting the nozzles 702, before the fluid reaches the annulus of the first wellbore 102. In alternate embodiments, diffusers 610 can be separate parts that are coupled to the top and bottom housings 606, 608. The diffusers 610 can have leading edges 802 that are sloped, as described above with reference to FIGS. 4-5.

Figure 9:
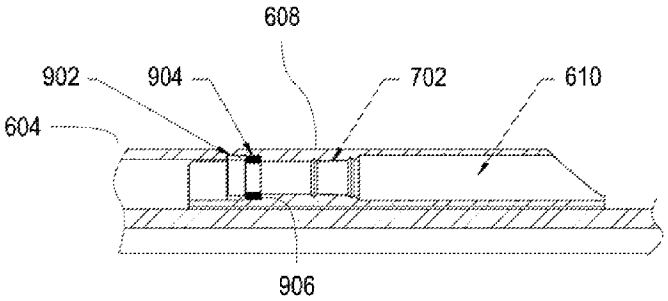
FIG. 9 is a close-up cross-sectional view of the bottom housing of FIGS. 6-8, according to one embodiment.

FIG. 9 is a close-up cross-sectional view of the bottom housing 608 of FIGS. 6-8, according to one embodiment. The top housing 606 can be made as described herein with reference to the bottom housing 608. The bottom housing 608 can include a nozzle 702 and a diffuser 610. Each nozzle 702 can further include a choke 904. The choke 904 can have an opening with an internal diameter that restricts fluid flow through the nozzle 702. The choke 904 can be made of an erosion-resistant material, such as carbide, ceramic, nitrided steel, or any other material with increased hardness that can resist erosion.

The choke 904 can be held in place in the nozzle 702 on one side by a shoulder 906 and on the other side by a retaining ring 902. The retaining ring 902 can be made of the same material as the housing. The retaining ring 902 can help keep the choke 904 from falling out due to extreme temperature changes. For example, during steam injection, hot steam can cause the bottom housing 608 to expand at a different rate than the choke 904, which may afford an opportunity for the choke 904 to fall out of place if it were not held in place by the retaining ring 902. In some embodiments the shroud 604, when coupled to the bottom housing 608, can help retain one or both of the choke 904 and retaining ring 902 in place.

Figure 10:
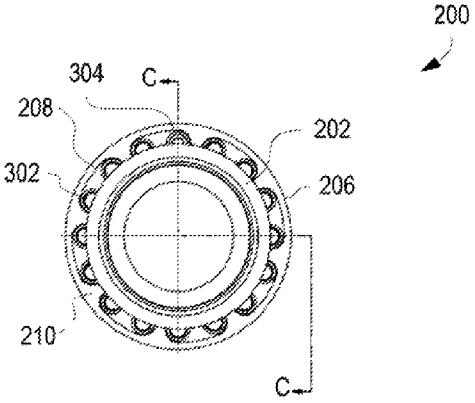
FIG. 10 is a top view of a fluid injection tool as seen looking towards the top sub and the top end of the injection housing according to one embodiment.

FIG. 10 is a top view of a fluid injection tool 200 as seen looking towards the top sub 202 and the top end 210 of the injection housing 206 according to one embodiment. The injection housing 206 includes several nozzles 302 and diffusers 208 and a plug 304.

Figure 11:
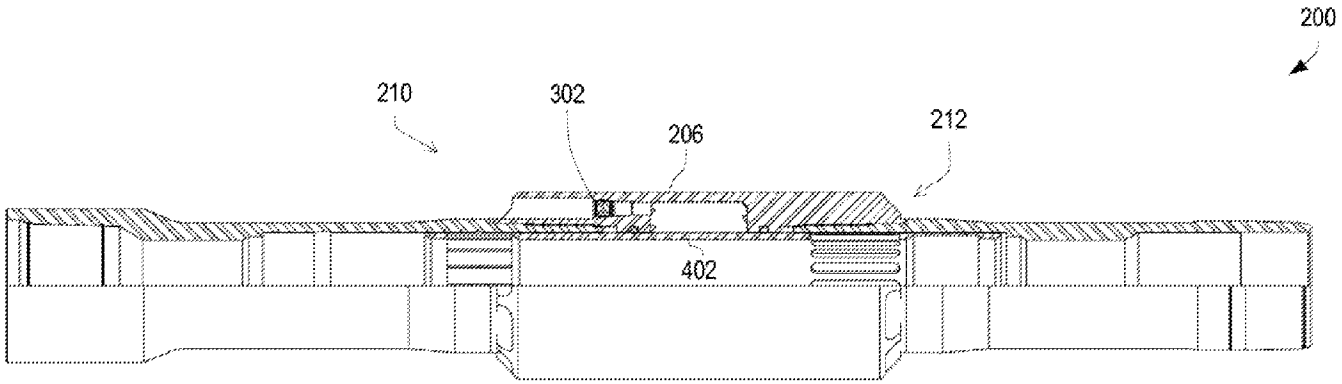
FIG. 11 is a partial cross-sectional view of the fluid injection tool of FIG. 10 taken across line C-C with the sliding door in a closed configuration according to one embodiment.

FIG. 11 is a partial cross-sectional view of the fluid injection tool 200 of FIG. 10 taken across line C-C with the sliding door 402 in a closed configuration according to one embodiment. The injection housing 206 of the fluid injection tool 200 shown in FIGS. 10-11 has a top end 210 containing nozzles 302, however the bottom end 212 contains no nozzles 302. In this embodiment, fluid can only be injection out of the top side 210 of the injection housing 206. Other embodiments may exist, including top ends 210 and bottom ends 212 with different number of nozzles and with the top end 210 having no nozzles while the bottom end 212 includes nozzles.

Due to the configurability of the disclosed fluid injection tools, plugs can be removed or added to a reused fluid injection tool to adjust the flow rate for a different installation. Additionally, the modular design of the fluid injection tools disclosed herein can aid in repair, if necessary.

All patents, publications and abstracts cited above are incorporated herein by reference in their entirety. Various embodiments have been described. It should be recognized that these embodiments are merely illustrative of the principles of the present disclosure. Numerous modifications and adaptations thereof will be readily apparent to those skilled in the art without departing from the spirit and scope of the present disclosure as defined in the following claims.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

What is claimed is:

1. A fluid injection tool comprising:

an accumulation chamber in fluid communication with a plurality of nozzles within a first housing, wherein a first nozzle of the plurality of nozzles has a first inner diameter and a second nozzle of the plurality of nozzles has a second inner diameter that is different than the first inner diameter, and the first nozzle and second nozzle are individually pluggable;

a tubular having an orifice for communicating a fluid between an inner diameter of the fluid injection tool and the accumulation chamber;

at least one diffuser in fluid communication with the plurality of nozzles, the at least one diffuser comprising an opening formed from or within the first housing and being positioned opposite the accumulation chamber from the plurality of nozzles.

2. The fluid injection tool of claim 1, further comprising a plug positionable to at least partially restrict flow of the fluid through at least one of the plurality of nozzles.

3. The fluid injection tool of claim 2, wherein the plug is positionable to fully restrict flow of the fluid through the at least one of the plurality of nozzles.

4. The fluid injection tool of claim 1, additionally comprising a sliding door positioned within the inner diameter of the fluid injection tool, the sliding door containing the orifice and slidable between an open configuration where the orifice allows fluid communication between the inner diameter of the fluid injection tool and the accumulation chamber and a closed configuration where the sliding door blocks fluid communication between the inner diameter of the fluid injection tool and the accumulation chamber.

5. The fluid injection tool of claim 1, wherein each of the at least one diffuser forms a single piece with a respective one nozzle of the plurality of nozzles.

6. The fluid injection tool of claim 5, wherein:

the first housing is coupled to a base pipe that includes the orifice;

a shroud is coupled to the first housing; and a second housing is coupled to the shroud and the base pipe to form the accumulation chamber in between the first housing, the base pipe, the shroud, and the second housing.

7. A method, comprising:

supplying fluid to an accumulation chamber of a fluid injection tool through at least one orifice from an inner diameter of the fluid injection tool;

directing the fluid to a plurality of nozzles fluidly connected to the accumulation chamber, wherein a first nozzle of the plurality of nozzles has a first inner diameter and a second nozzle of the plurality of nozzles has a second inner diameter that is different than the first inner diameter, and the first nozzle and second nozzle are individually pluggable; and directing the fluid from at least a first subset of the plurality of nozzles through one or more open shapes in fluid communication with the plurality of nozzles.

8. The method of claim 7, additionally comprising at least partially restricting flow of the fluid through a second subset of the plurality of nozzles by one or more removable plugs.

9. The method of claim 8, wherein at least partially restricting flow of the fluid includes fully restricting flow of the fluid through the second subset of the plurality of nozzles by the one or more removable plugs.

10. The method of claim 7, additionally comprising shifting a sliding door containing the at least one orifice between an open configuration where the at least one orifice allows fluid communication between the inner diameter of the fluid injection tool and the accumulation chamber and a closed configuration where the sliding door blocks fluid communication between the inner diameter of the fluid injection tool and the accumulation chamber.

11. A fluid injection tool comprising:

an accumulation chamber in fluid communication with a plurality of nozzles, at least a first nozzle and a second nozzle of the plurality of nozzles being individually pluggable and positioned to communicate steam axially in both directions along an annulus formed between the fluid injection tool and a casing or wellbore, and wherein the first nozzle has a first inner diameter and the second nozzle has a second inner diameter that is different than the first inner diameter;

a tubular having an orifice for communicating a fluid between an inner diameter of the fluid injection tool and the accumulation chamber; and a plug positionable in at least one of the plurality of nozzles that at least partially restricts flow of the fluid out of the fluid injection tool.

12. The fluid injection tool of claim 11, wherein the plug is positionable to fully restrict flow of the fluid through the at least one of the plurality of nozzles.

13. The fluid injection tool of claim 11, additionally comprising a sliding door positioned within the inner diameter of the fluid injection tool, the sliding door containing the orifice and slidable between an open configuration where the orifice allows fluid communication between the inner diameter of the fluid injection tool and the accumulation chamber and a closed configuration where the sliding door blocks fluid communication between the inner diameter of the fluid injection tool and the accumulation chamber.

14. The fluid injection tool of claim 11, further comprising at least one diffuser in fluid communication with the plurality of nozzles, the plurality of nozzles separating the at least one diffuser and the accumulation chamber.

15. The fluid injection tool of claim 14, wherein each of the at least one diffuser forms a single piece with a respective one nozzle of the plurality of nozzles.

16. The fluid injection tool of claim 15, wherein:

a first housing includes at least a subset of the plurality of nozzles and the at least one diffuser;

the first housing is coupled to a base pipe that includes the orifice;

a shroud is coupled to the first housing; and a second housing is coupled to the shroud and the base pipe to form the accumulation chamber in between the first housing, the base pipe, the shroud, and the second housing.

* * * * *